US009511372B2

(12) United States Patent
Gronvall et al.

(10) Patent No.: US 9,511,372 B2
(45) Date of Patent: Dec. 6, 2016

(54) BIMATERIAL ELONGATED INSERT MEMBER FOR A GRINDING ROLL

(71) Applicant: Metso Minerals (Wear Protection) AB, Trelleborg (SE)

(72) Inventors: Lars Gronvall, Trelleborg (SE); Pekka Siitonen, Lempaala (FI); Mikko Kaipiainen, Tampere (FI); Jari Liimatainen, Tampere (FI)

(73) Assignee: Metso Sweden AB, Trelleborg (SE)

( * ) Notice: Subject to any disclaimer, the term of this patent is extended or adjusted under 35 U.S.C. 154(b) by 0 days.

(21) Appl. No.: 15/148,413

(22) Filed: May 6, 2016

(65) Prior Publication Data

US 2016/0250645 A1 Sep. 1, 2016

Related U.S. Application Data

(62) Division of application No. 13/516,273, filed as application No. PCT/EP2009/067570 on Dec. 18, 2009, now Pat. No. 9,352,325.

(51) Int. Cl.
*B02C 4/00* (2006.01)
*B02C 4/30* (2006.01)

(52) U.S. Cl.
CPC ..... *B02C 4/305* (2013.01); *B02C 4/30* (2013.01); *B02C 2210/02* (2013.01)

(58) Field of Classification Search
CPC ..... B02C 4/305; B02C 4/30; B02C 2/005; B02C 2210/02
USPC ..... 241/294, 300
See application file for complete search history.

(56) References Cited

U.S. PATENT DOCUMENTS

| | | | |
|---|---|---|---|
| 139,105 | A | 5/1873 | Barr |
| 412,558 | A | 10/1889 | Stephens |
| 4,773,600 | A | 9/1988 | Metski |
| 4,960,472 | A | 10/1990 | Bruck et al. |
| 5,269,477 | A | 12/1993 | Buchholtz et al. |
| 5,704,561 | A | 1/1998 | Ansen et al. |
| 5,875,862 | A | 3/1999 | Jurewicz et al. |
| 5,967,431 | A | 10/1999 | Stafford et al. |
| 6,094,795 | A | 8/2000 | Davenport |
| 6,309,762 | B1 | 10/2001 | Speckert |
| 6,523,767 | B1 | 2/2003 | Ramesohl |

(Continued)

FOREIGN PATENT DOCUMENTS

| | | |
|---|---|---|
| DE | 197 09 263 | 9/1998 |
| DE | 10 2006 014 874 | 10/2007 |
| WO | 2007/085694 | 8/2007 |

OTHER PUBLICATIONS

International Search Report for International Application No. PSC/EP2009/067570 mailed Sep. 7, 2010.

*Primary Examiner* — Faye Francis
(74) *Attorney, Agent, or Firm* — Andrus Intellectual Property Law, LLP

(57) ABSTRACT

The disclosure relates to an elongated insert member for a grinding roll for heavy wear operation. The insert member includes a core of a first material having a first hardness, the core having an extension in the longitudinal direction of the insert member, and a body of a second material having a second hardness, the body enclosing the core. The first hardness is greater than the second hardness. The disclosure also relates to a cassette and a segment for a grinding roll, a grinding roll and a roll machine.

13 Claims, 5 Drawing Sheets

(56) References Cited

U.S. PATENT DOCUMENTS

| | | | |
|---|---|---|---|
| 6,739,327 | B2 | 5/2004 | Sollami |
| 6,758,530 | B2 | 7/2004 | Sollami |
| 7,469,971 | B2 | 12/2008 | Hall et al. |
| 7,497,396 | B2 | 3/2009 | Splinter et al. |
| 7,510,135 | B2 | 3/2009 | Burchardt et al. |
| 7,523,794 | B2 | 4/2009 | Hall et al. |
| 7,594,703 | B2 | 9/2009 | Hall et al. |
| 8,316,543 | B2 | 11/2012 | Patzelt et al. |
| 2003/0209366 | A1 | 11/2003 | McAlvain |
| 2004/0026983 | A1 | 2/2004 | McAlvain |
| 2004/0065484 | A1 | 4/2004 | McAlvain |
| 2008/0041994 | A1 | 2/2008 | Hall et al. |
| 2008/0211290 | A1 | 9/2008 | Hall et al. |
| 2009/0108664 | A1 | 4/2009 | Hall et al. |
| 2009/0133938 | A1 | 5/2009 | Hall et al. |
| 2013/0299618 | A1 | 11/2013 | Sharman |
| 2014/0361108 | A1 | 12/2014 | Euculano et al. |

BIMATERIAL ELONGATED INSERT MEMBER FOR A GRINDING ROLL

CROSS-REFERENCE TO RELATED APPLICATIONS

This application is a divisional application of prior U.S. patent application Ser. No. 13/516,276, filed on Aug. 23, 2012, now issued as U.S. Pat. No. 9,352,325, which application claims priority to PCT/EP2009/067570, filed Dec. 18, 2009, and published in the English language as Publication No. WO 2011/072754 on Jun. 23, 2011, incorporated herein by reference.

TECHNICAL FIELD

The present invention relates to an elongated insert member for a grinding roll for heavy wear operation. The invention also relates to a cassette and a segment for a grinding roll, a grinding roll and a roll machine.

BACKGROUND ART

When materials are crushed or pulverised using interparticle crushing, two opposed rotatably mounted rolls, separated from each other by a gap, form a draw-in nip where the materials are drawn in, either force fed or fed by gravity, and crushed against each other. An advantage of interparticle crushing is that an effective crushing may be achieved, even to very small grain sizes, with a reduced energy consumption as compared to many other crushing techniques. Further, the level of noise during the process is essentially reduced as compared to other crushing techniques.

The present invention relates to an improved wear resistant element for a roll arrangement using interparticle crushing and single particle crushing wherein great wear conditions exist during crushing or pulverising of materials between two rolls in the roller arrangement. The outer surfaces of the roll are subjected to extraordinarily high stressing from which, among other things, high wear emerges. It has been known to counter this wear by means of different shaping and coating of the roll surfaces exposed to the wear.

EP-699 479 discloses rolls of high-pressure roll presses for the compressive size reduction of granular material having hard surfaces with nub pins which are wear-resistant and suitable for autogenous wear protection. The nub pins, which have a long potential service life even under the action of high compressive loads, have a radially inner pin part which is easily welded to the roll surface and a radially outer harder pin part protectively covering the radially inner pin part.

There are problems associated with the above mentioned technique. Due to the enormous amount of stress applied on the rollers, the wear resistant nub pins inserted into the surface regions of the rollers must be able to handle a large amount of pressure without failure. However, even nub pins as describes in EP-699 479 wear down in a pace being unsatisfying. The edges of the nub pins are particularly exposed and have a tendency of breaking prematurely, thereby accelerating the wear pace of the nub pins.

SUMMARY OF THE INVENTION

It is an object of the present invention to provide an improvement of the above technique and prior art. More particularly, it is an object of the present invention to provide an improved insert member for a grinding roll such that the outer surface of the grinding roll is given a high wear resistance. Further, it is an object of the present invention to provide a cassette and a segment for a grinding roll, a grinding roll and a roll machine.

These and other objects as well as advantages that will be apparent from the following description of the present invention are achieved by an elongated insert member for a grinding roll for heavy wear operation according to the independent claim.

An elongated insert member for a grinding roll for heavy wear operation is provided. The insert member comprises a core of a first material having a first hardness, said core having an extension in the longitudinal direction of said insert member, and a body of a second material having a second hardness, said body enclosing said core. The first hardness is greater than the second hardness. This is advantageous in that an insert member with this type of structure is considerably more reliable than the hard metal studs according to the prior art. Due to a more ductile body of the insert member, hard metal grades having less binding content can be used making the insert member more wear resistant. This in turn leads to a decreased amount of insert member failure, which in current grinding rolls incorporating wear resistant insert members has lead to failures during use. A more ductile body of the insert member further counteracts prematurely breakage of the edges of the insert members, which are particularly exposed to wear. When the insert member is subjected to wear, the ductile but tough body will be worn off rather quickly on the top of the insert member, thereby exposing the core. Accordingly, the top of the insert member being subjected to wear will be constituted by a hard and wear resistant core enclosed in a radial direction by a more tough but ductile body. Since the surface of the body being subjected to wear is so much smaller than the surface of the core being subjected to wear, the body and the core will wear off in a approximately the same pace. As mentioned above, the body of the insert member also function as a protection for the more sensitive edges of the core. Another advantage of having a tough but more ductile body is that the insert members are made less likely to dislodge from the grinding roll due to the elasticity created between the insert member and the grinding roll when attached.

The first material may have a first toughness and the second material a second toughness, the first toughness being smaller than the second toughness, which is advantageous in that the effects of a more ductile body are further enhanced.

The first material may be selected from a group comprising metallic material, ceramic material or a combination thereof, which is advantageous in that this material is very resistant against wear.

The second material may be selected from a group comprising metallic material, ceramic material or a combination thereof, which is advantageous in that this material is very resistant against wear.

The first material may have a preferred hardness from at least 600 to 1200 HV. This is an especially preferred hardness of the core of the insert member.

The second material may have a preferred hardness from 400 to 1200 HV. This is an especially preferred hardness of the body of the insert member.

The cross-section of the insert member may be cylindrical and the insert member may have the shape of a pin. This simple shape makes the insert members easy to manufacture.

The core may be cylindrical, which is a simple shape making an insert member with such a core easy to manufacture.

The geometric center axis of said core may be unaligned with the geometric center axis of said insert member.

The core may extend along the entire length of said insert member in the longitudinal direction.

The core may extend from the top of said insert member and along a part of the length of said insert member in the longitudinal direction.

Accordingly, the insert member may be adapted to different shapes and sizes in order to obtain the characteristics needed for a certain crushing operation, depending on what kind of material which is to be crushed or pulverised.

The outer surface of said insert member may be profiled, which is advantageous in that an uneven surface is provided on the roll, thereby improving the drawing-in of the material to be crushed. Additionally, the materials to be crushed or pulverised filling the spaces created between the insert members and thereby creating an autogenous protection of the roll, is retained due to the uneven surface of the insert members.

According to a second aspect of the invention, the invention relates to a cassette for a grinding roll for heavy wear operation, comprising a plurality of insert members according to the above described features.

According to a third aspect of the invention, the invention relates to a segment for a grinding roll for heavy wear operation, comprising a plurality of insert members or cassettes according the features above.

According to a fourth aspect of the invention, the invention relates to a grinding roll for heavy wear operation comprising a plurality of insert members, cassettes or segments according the features above.

According to a fifth aspect of the invention, the invention relates to a roll machine for comminuting a bed of material, comprising at least one grinding roll according to the features above.

According to a sixth aspect of the invention, the invention relates to a method for improving the wear resistance of a high pressure grinding roll. The method comprises manufacturing a grinding roll, arranging at least one recess to the circumference of said grinding roll, manufacturing at least one insert member, and arranging and attaching said at least one insert member to said at least one recess, wherein the step of manufacturing said at least one insert member comprises arranging a core of a first material having a first hardness in a body of a second material having a second hardness, said core having an extension in the longitudinal direction of said at least one insert member and said body enclosing said core, wherein the first hardness is greater than the second hardness. This is advantageous in that it results in a reliable attachment of the at least one insert member to the grinding roll, thereby securing a high wear resistance of the envelope surface of the grinding roll.

Generally, all terms used in the claims are to be interpreted according to their ordinary meaning in the technical field, unless explicitly defined otherwise herein. All references to "a/an/the [element, device, component, means, etc]" are to be interpreted openly as referring to at least one instance of said element, device, component, means, etc., unless explicitly stated otherwise. Further, by the term "toughness" it is meant the "fracture toughness" throughout the application, and by "comprising" it is meant "comprising but not limited to" throughout the application. The term "grinding" is meant to include "crushing".

BRIEF DESCRIPTION OF THE DRAWINGS

The above, as well as additional objects, features and advantages of the present invention, will be better understood through the following illustrative and non-limiting detailed description of preferred embodiments of the present invention, with reference to the appended drawings, where the same reference numerals will be used for similar elements, wherein.

DETAILED DESCRIPTION OF PREFERRED EMBODIMENTS OF THE INVENTION

Figure 1A:
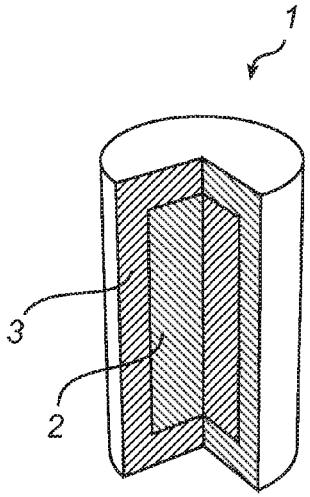
FIGS. 1*a-l* are perspective views of an insert member according to twelve different embodiments of the present invention.

FIG. 1*a* illustrates an insert member 1 for a grinding roll for heavy wear operation according to a first embodiment of the invention. The cross-section of the insert member 1 is cylindrical and it has the shape of a pin. The insert member 1 has a core 2 of a first material having a first hardness. The core 2 is cylindrical and extends in the longitudinal direction of the insert member 1. The geometric axis of the core 2 is aligned with the geometric axis of the inert member 1. The insert member 1 further has a body 3 of a second material having a second hardness, which body 3 completely encloses the core 2. The first hardness is greater than the second hardness. The first material, that is to say the material of the core 2 of the insert member 1, is preferably constituted by a metallic material, ceramic material or a combination thereof. However, other material solutions for the core 2 of the insert member 1 are naturally also possible. The first material has a preferred hardness from at least 600 to 1200 HV. The second material, that is to say the material of the body 3 of the insert member 1, is preferably constituted by a metallic material, ceramic material or a combination thereof. However, other material solutions for the body 3 of the insert member 1 are naturally also possible. The second material has a preferred hardness from 400 to 1200 HV. In a preferred embodiment of the invention, the first material has a first toughness and the second material has a second toughness, and the first toughness is smaller than the second toughness.

Figure 1B:
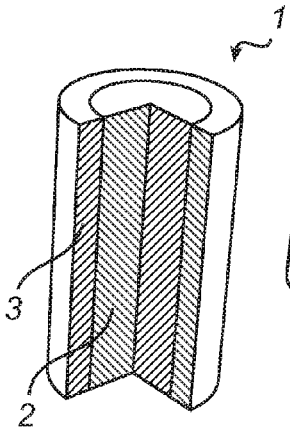

In FIG. 1*b*, the insert member 1 according to a second embodiment of the invention is illustrated. The core 2 is cylindrical and extends along the entire length of the insert member 1 in the longitudinal direction. The geometric axis of the core 2 is aligned with the geometric axis of the inert member 1. The body 3 of the insert member 1 radially encloses the core 2. The core 2 is thus exposed on the top and the bottom of the insert member 1, when standing in a vertical direction.

Figure 1C:
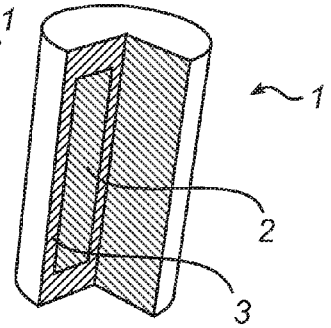
Figure 1D:
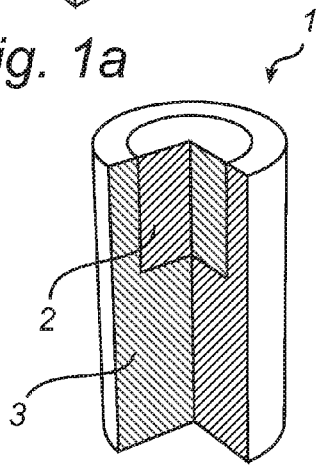

FIG. 1*c* illustrates the insert member 1 according to a third embodiment of the invention. The core 2 is cylindrical and extends in the longitudinal direction of the insert member 1. The geometric axis of the core 2 is offset or displaced with respect to the geometric axis of the insert member 1. The body 3 of the insert member 1 completely encloses the core 2. In FIG. 1*d*, the insert member 1 according to a fourth embodiment of the invention is illustrated. The core 2 is cylindrical and extends from the top of the insert member 1 and along a part of the length of the insert member in the longitudinal direction. The geometric axis of the core 2 is aligned with the geometric axis of the insert member 1. The body 3 of the insert member 1 radially encloses the core 2. The core 2 is exposed on the top of the insert member 1, when standing in a vertical direction.

Figure 1E:
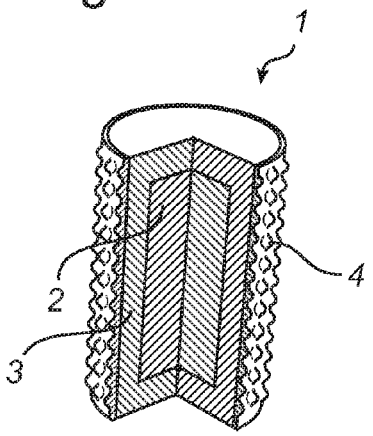

FIG. 1*e* illustrates the insert member 1 according to a fifth embodiment of the invention. The core 2 is cylindrical and extends in the longitudinal direction of the insert member 1. The geometric axis of the core 2 is aligned with the geometric axis of the insert member 1. The body 3 of the insert member 1 completely encloses the core 2. The outer surface 4 of the insert member 1 is profiled. That is to say, the outer surface 4 of the insert member 1 is provided with bulges in order to help keeping the material to be crushed or pulverized in the spaces created between the insert members 1 when provided on a roll, such that a protective autogenous layer is created and maintained during use of that roll. The bulges may be formed integrally with the body 3 or may be provided as a sleeve arranged on said body.

Figure 1F:
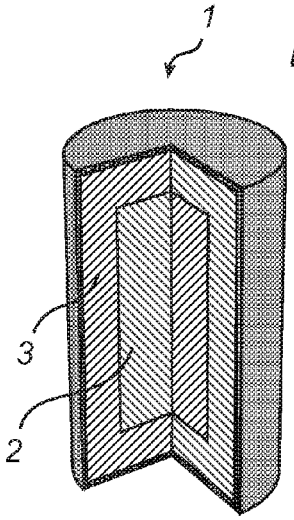

In FIG. 1*f*, the insert member 1 according to a sixth embodiment of the invention is illustrated. The core 2 is cylindrical and extends in the longitudinal direction of the insert member 1. The geometric axis of the core 2 is aligned with the geometric axis of the insert member 1. The body 3 of the insert member 1 completely encloses the core 2. The whole body 2 is covered with a surface layer or coating. The surface layer or the coating may be obtained by dipping the insert member 1 into a liquid coating and allowing it to dry on the insert member surface or to react with the insert member surface. The coating or surface layer may also be obtained by mechanical or physical processes, for example by deposition or carburizing.

Figure 1G:
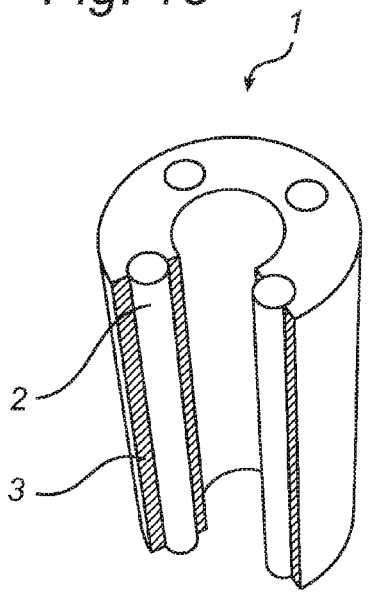

FIG. 1*g* illustrates the insert member 1 according to a seventh embodiment of the invention. The body 3 has the form of a hollow tube, having ring-like cross sectional form. Accordingly, in the centre of the insert member 1 is an empty and hollow space, which will be filled with the material to be ground in the grinding process. A plurality of circular cores 2 are inserted into the ring-like body 3. The cores 2 have parallel longitudinal axes.

Figure 1H:
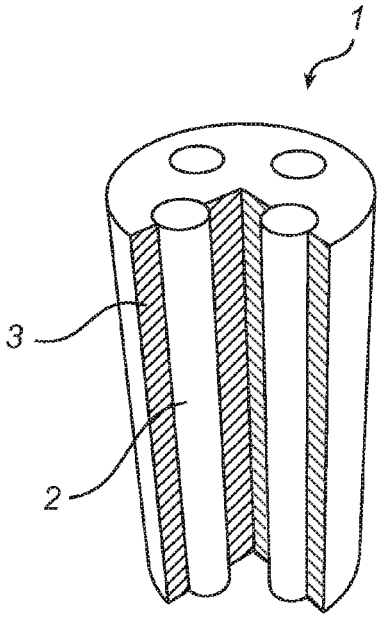

In FIG. 1*h*, the insert member 1 according to an eight embodiment of the invention is illustrated. The insert member 1 has a circular cross section and plurality of circular cores 2 inserted into the body 3. The cores 2 are parallel and they are of the same size, i.e. their cross sectional areas are the same. However, it is not necessary in the embodiments employing a plurality of cores in one single body that all the cores are of same size. They may differ from each other and have different lengths, cross sectional forms and/or cross sectional areas. Also, the cores may be made of different materials. This improves the possibility to tailor the insert member properties for different materials to be ground and/or for different locations on the grinding roll surface.

Figure 1I:
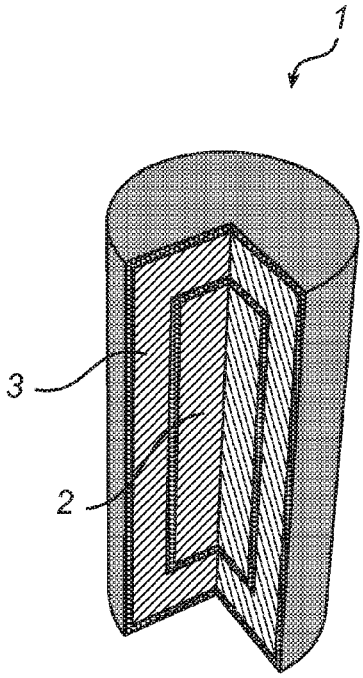

FIG. 1*i* illustrates the insert member 1 according to a ninth embodiment of the invention. The insert member 1 has a circular cross section. A circular core 2 is inserted into the centre of a circular body 3 so that the longitudinal axes of the core 2 and body 3 are parallel and overlapping each other. The insert member 1 comprises also an intermediate layer arranged between the core 2 and the body 3. The intermediate layer may improve the mechanical properties of the insert member 1 or it may improve the attachment of the core 2 to the body 3. The insert member 1 comprises also a coating on the outer surface of the body 3. The coating may also improve the mechanical properties of the insert member 1 or the attachment of the insert member 1 to the grinding roll. The intermediate layer and the coating may be of the same or different material.

Figure 1J:
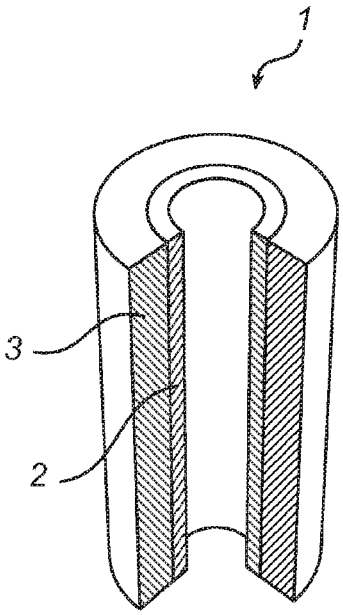

In FIG. 1*j*, the insert member 1 according to a tenth embodiment of the invention is illustrated. The insert member 1 has a body 3 in form of a hollow tube, having ring-like cross sectional form. The core 2 is arranged on the inner surface of the body 3, and the core 2 is thus also in form of a hollow tube with a ring-like cross sectional form. In the centre of the insert member 1 is an empty and hollow space, defined by the core material.

Figure 1K:
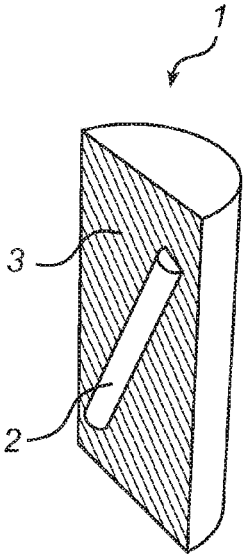

FIG. 1*k* illustrates the insert member 1 according to an eleventh embodiment of the invention. The core 2 is cylindrical and substantially extends in the diagonal direction of the insert member 1 when standing up. The geometric axis of the core 2 is thus angled with respect to the geometric axis of the insert member 1. The angle of the geometric axis of the core in relation to the geometric axis of the insert member may naturally be varied. The body 3 of the insert member 1 completely encloses the core 2. However, the core 2 may be exposed at the top and the bottom of the insert member 1. Also, different sizes and shapes of the core 2 are naturally possible. When crushing material using grinding rolls having insert members, it is likely that the material to be crushed hits the insert members diagonally from the top of the insert member. By orienting the core 2 of the insert member 1 in different angles in relation to the insert member 1, the wear-resistance of the insert member 1 may be especially enhanced in the directions of the insert member 1 believed to be heavily exposed to wear. Naturally, different sizes and shapes of the insert member 1 are also possible.

Figure 1L:
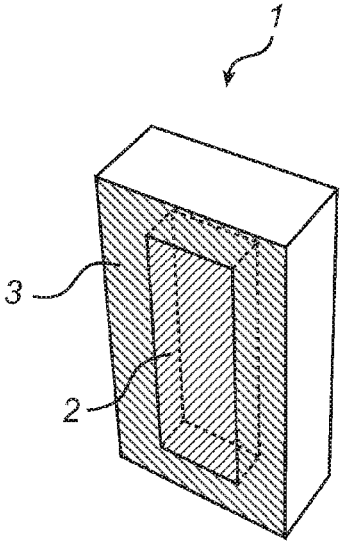

FIG. 1*l* illustrates the insert member 1 according to a twelfth embodiment of the invention. The cross-section of the insert member 1 and the core 2 is quadratic. The core 2 extends in the longitudinal direction of the insert member 1. The geometric axis of the core 2 is aligned with the geometric axis of the insert member 1. The body 3 of the insert member 1 completely encloses the core 2.

Figure 2:
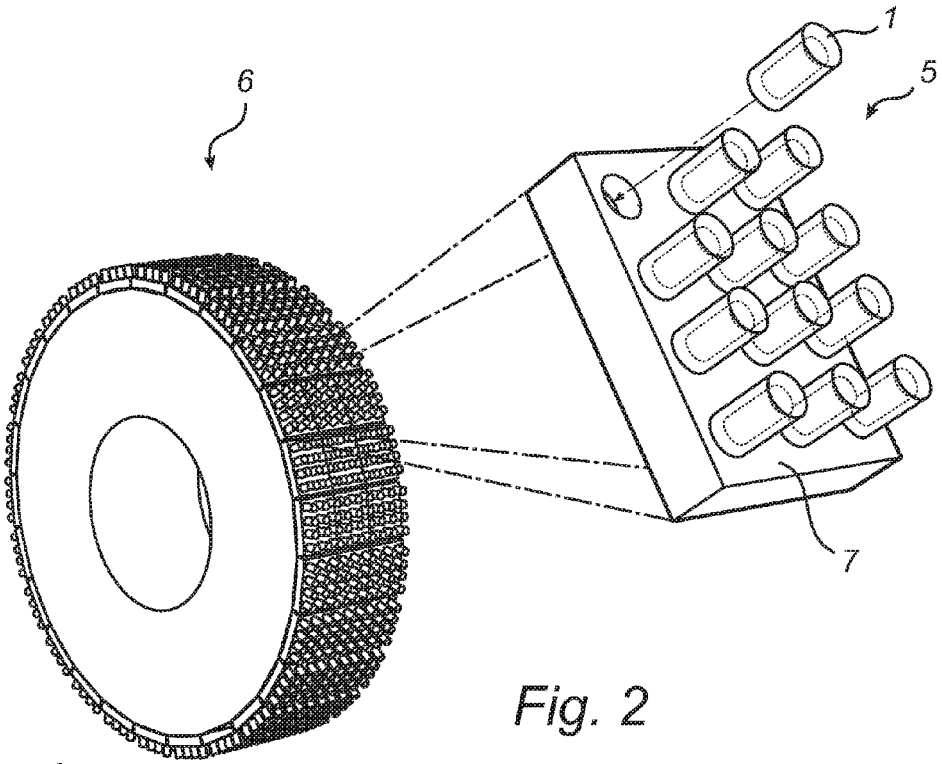
FIG. 2 is a perspective view of a cassette for a grinding roll comprising a plurality of insert members.

In FIG. 2, a cassette 5 for a grinding roll 6 is illustrated. The cassette 5 comprises a plurality of insert members 1. The cassettes 5 are to be attached to the envelope surface of the grinding roll 6, thereby facilitating both mounting and possible replacement or service of the insert members 1. The outer surface 7 of the cassettes 5 surrounding the insert members 1 may be coated or treated, for example carburized, in order to be more resistant to wear.

Figure 3:
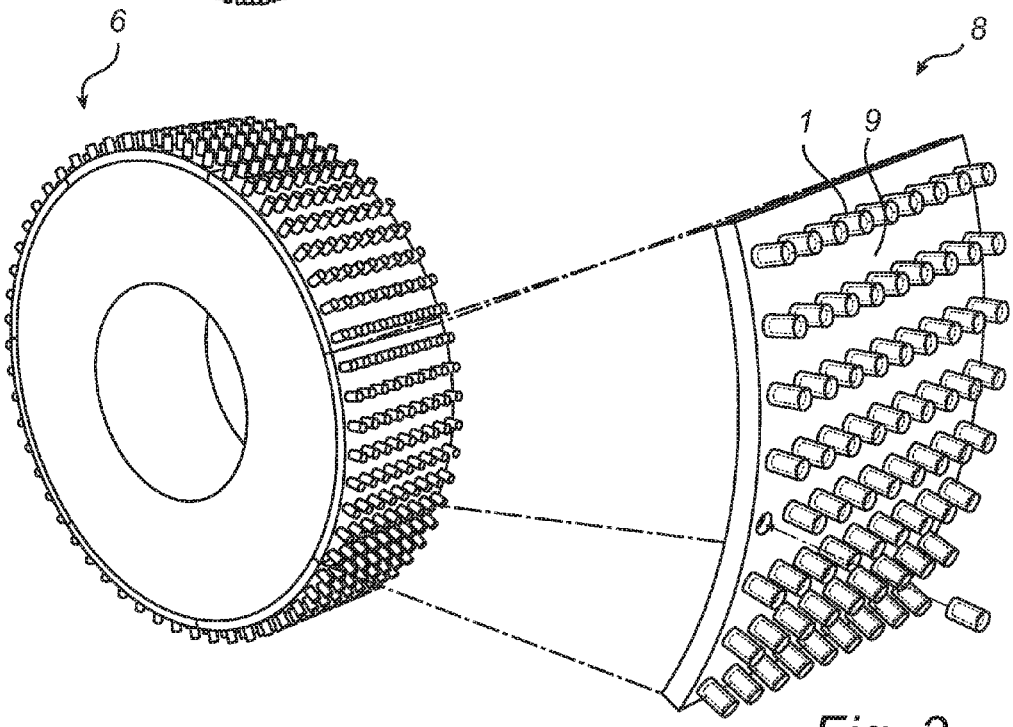
FIG. 3 is a perspective view of a segment for a grinding roll comprising a plurality of cassettes or insert members.

FIG. 3 illustrates a segment 8 for a grinding roll 6 for heavy wear operation. The segment 8 comprises a plurality of insert members 1. The segments 8 are to be attached to the envelope surface of the grinding roll 6, thereby facilitating both mounting and possible replacement or serving of the insert members 1. The outer surface 9 of the segments 8 surrounding the insert members 1 may be coated or treated, for example carburized, in order to be more resistant to wear.

Figure 4:
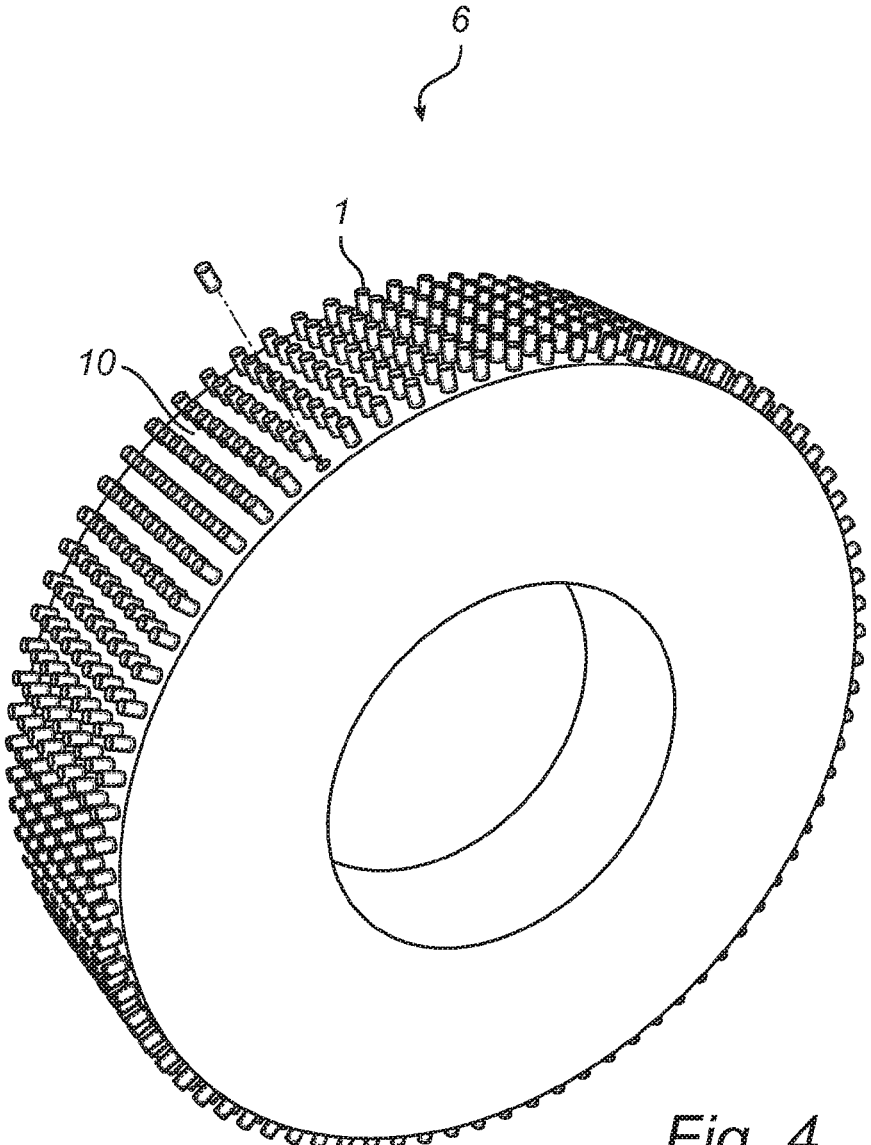
FIG. 4 is a perspective view of a grinding roll comprising a plurality of segments, cassettes or insert members.

In FIG. 4, a grinding roll 6 for heavy wear operation is illustrated. The grinding roll 8 comprises a plurality of insert members 1. The insert members are to be attached to the envelope surface of the grinding roll 6. The attachment of the insert members 1 to the envelope surface of the grinding roll 5 can be made in many different ways. For example, cassettes 4 or segments 8 as described above may be used in order to facilitate the mounting of the insert members 1. Another possibility is the use of a binding ring. The outer surface 10 of the roll 5 (or the cassettes, segments, binding ring etc.) surrounding the insert members 1 may be coated or treated, for example carburized, in order to be more resistant to wear.

The insert members may be fastened in the envelope surface of the grinding roll, or in a cassette or a segment, by a number of different techniques. Thus, the individual insert element may for example be fastened by means of shrink fit, welding, gluing, clamping, wedging or a screw joint.

Figure 5:
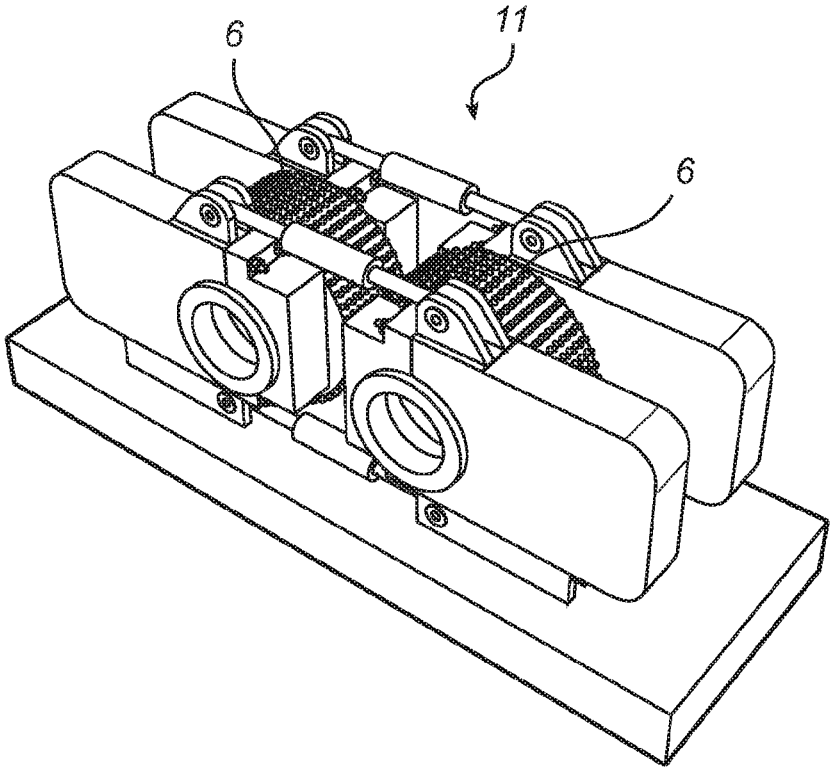
FIG. 5 is a perspective view of a roll machine comprising at least one grinding roll.

FIG. 5 illustrates a roll machine 11 for comminuting a bed of material. The roll machine 11 comprises two grinding rolls 6. During use, the insert members 1 attached the grinding rolls 6 of the roll machine 11 will be subjected to wear. When the insert member 1 is subjected to wear, the ductile but tough body 3 will be worn off rather quickly on the top of the insert member 1 thereby exposing the core 2. Accordingly, the top of the insert member 1 being subjected to wear will be constituted by a hard and wear resistant core 2 enclosed in a radial direction by a more though but ductile body 3. Since surface of the body 3 being subjected to wear is so much smaller than the surface of the core 2 being subjected to wear, the body 3 and the core 2 will wear off in a approximately the same pace. This leads to a longer life time of the insert members 1 and thus of the grinding rolls 6.

In order to even further prolong the life time of the grinding rolls 6, they may be provided with a wear resistant layer on the envelope surface covering the spaces created on the grinding rolls 6 between the insert members 1. The wear resistant layer reduces the wear caused below the autogenous layer created between the insert members 1 and also protects the surface from wear in the case of failure of the insert members 1. The wear resistant layer may for example be made of a tool steel material.

Figure 6:
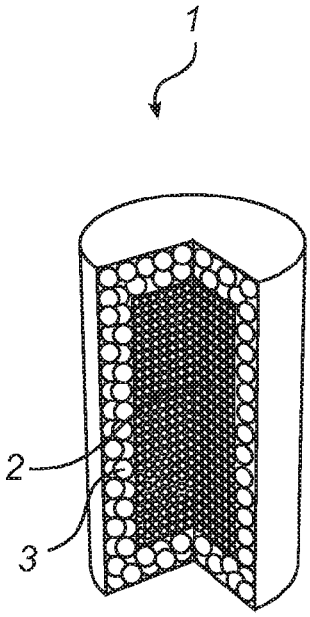
FIG. 6 is a perspective view of an insert member according to ninth embodiment of the invention.

In FIG. 6, the insert member 1 according to a ninth embodiment is illustrated. In this embodiment, the first and the second material is of the same material type. That is to say, that the entire insert member 1 is made of one material type. Thus, both materials may contain grains of a single, specific material type, but the grain size may be varied in the two materials. The body 3 may thus be formed by a first material comprising grains which are bigger than the grains of a second material forming the core 2 in order to obtain the same effect as for the other embodiments of the insert member 1. Thus, the hardness of the core 2 is greater than the hardness of the body 3 and the toughness of the core 2 is smaller than the toughness of the body 3. The core 2 is cylindrical and extends in the longitudinal direction of the insert member 1. The geometric axis of the core 2 is aligned with the geometric axis of the insert member 1. The body 3 of the insert member 1 completely encloses the core 2.

In use, two grinding rolls are arranged essentially parallel to each other with a gap between them. Material to be crushed is fed into the gap, generally choke fed, but possibly by gravity only, and crushed between the grinding rolls. In interparticle crushing, only part of the crushing work is performed by the crushing surface of the grinding rolls and part of the crushing takes place in the material bed formed between the grinding rolls as particles in the material bed grind against each other. The spaces between the insert members will fill with crushed material, thereby creating a protective wear resistant layer. Thus, the wear on the actual envelope surface is reduced, prolonging the working life of the grinding roll.

The first material of the core and the second material of the body may have same chemical composition, i.e. they may be chemically the same, but they are different in their physical properties, such as Vickers hardness and/or fracture toughness. The difference in the physical properties may be achieved by different treatment of the first and second material, e.g. by hardening.

The body may be made of a material having a Vickers hardness value in the range of 400-1200 HV, and the core may be made of a material having a Vickers hardness value of at least 600-1200 HV. According to one embodiment of the invention the body has a Vickers hardness of at least 600 HV, and the core has a Vickers hardness of at least 1000 HV. Preferably, the body has a Vickers hardness of at least 1000 HV, whereby the core has a Vickers hardness of at least 1200 HV. The hardness of the core is always higher than the hardness of the body, thus providing the improved wear resistance and fracture toughness properties during grinding of hard and abrasive mineral materials.

The first material, which is used for making the core, has typically a fracture toughness, which is lower than the fracture toughness of the second material. The fracture toughness on the first material is typically <18 $MN/m^{3/2}$, often in the range of 10-18 $MN/m^{3/2}$, more typically in the range of 11-16 $MN/m^{3/2}$, preferably in the range of 12-14 $MN/m^{3/2}$. Usually, the wear resistance of the first material is higher than the wear resistance of the second material. The first material may be a composite of metal and ceramic, so called Cermet or hardmetal, where the metal functions as a binder. Typical binder may be, for example, cobalt, and the binder content may be 0-20 weight-%. Other metals that may be used as binder are cobalt based alloys, nickel and nickel based alloys, titanium and titanium based alloys, iron based alloys as well as molybdenum and molybdenum based alloys. The ceramic material may be any suitable carbide material, such as tungsten carbide (WC), titanium carbide (TiC), vanadium carbide (VC), cromium carbide (CrC), tantalum carbide (TaC), a mixture of two or more carbides, or a mixture of two or more ceramic materials. The first material may also be a metal oxide, such as partially stabilised zirconium oxide or aluminium oxide, or a metal nitride or a metal boride. The first material may also be a ceramic carbide material.

According to one embodiment of the invention the second material, which is used for making the body, has a fracture toughness of at least 14 $MN/m^{3/2}$, typically in the range of 15-30 $MN/m^{3/2}$, more typically in the range of 16-25 $MN/m^{3/2}$, more preferably in the range of 18-25 $MN/m^{3/2}$. The second material may be a composite of metal and ceramic, so called Cermet or hard metal, in which composite the metal functions as a binder. Typical metal binder may be, for example, cobalt, and the binder content may be 10-25 weight-%. Other metals that may be used as binder are cobalt based alloys, nickel and nickel based alloys, titanium and titanium based alloys, iron based alloys as well as molybdenum and molybdenum based alloys. The ceramic material may be any suitable carbide material, such as tungsten carbide (WC), titanium carbide (TiC), vanadium carbide (VC), cromium carbide (CrC), tantalum carbide (TaC), a mixture of two or more carbides, or a mixture of two or more ceramic materials. The second material may also be a metal oxide, such as partially stabilised zirconium oxide or aluminium oxide, or a metal nitride or a metal boride. The second material may also be industrial diamond or tool steel, preferably tool steel. Tool steel is here understood as iron based material, which comprises a carbide, such as chromium carbide, vanadium carbide, niobium carbide, tungsten carbide or any combination thereof. Examples of tool steel types are carburizing steel, tempering steel, high speed steel, spray-formed steel or cast iron. Typically the Vickers hardness of tool steel is at least 400 HV, more typically at least 500 HV, more preferably at least 600 HV. The amount of carbide in the tool steel is at least 5 volume-%, typically over 10 volume-%, preferably over 20 volume-%.

According to one preferred embodiment of the present invention the body is made a material which is a Cermet or a hard metal, while the core is made a material which is also a Cermet or a hard metal. According to another preferred embodiment of the present invention the body is made of a material which is tool steel, while the core is made of a material which is a Cermet or a hard metal.

According to another preferred embodiment of the invention the hardness of the body varies throughout the body. The hardness may for example increase continuously from the outer surface of the body to the centre of the body, independent of the core inserted in the body.

The core may also be made of a plurality of individual core parts. For example, the core may comprise a number of cylindrical parts, which have been arranged into the body one after another. In this manner, the core is not continuous, but the core comprises a number of discontinuities where the one core part ends and the second core part starts. The ends of the individual core parts may be in contact with each other or there may be material between them. The discontinuity points of the core make the core more resistant for fracture, but the core still retains its wear improving properties. The core may comprise 2-4 individual core parts.

The cross sectional form of the core may be circular, elongated, triangular, quadrangular, parallelogram, polygon or irregular. The cross sectional form and area of the core is normally constant over the whole core length. In certain embodiments, however, it is possible that the diameter and the cross sectional area decrease from the first end towards the second end of the core, whereby the core has a shape of a truncated cone. It is also possible that the core is T-shaped.

Typically the length of the insert member is 25-100 mm, typically 30-80 mm, more typically 30-60 mm, and the total diameter of the insert member is in the range of 10-60 mm. The diameter of the core is typically 2-50 mm. It is also possible that the body comprises a plurality of parallel cores. One single body may comprise, for example 2-6, typically 2-4 parallel cores. These parallel cores may have a diameter in the range of 5-30 mm. When an insert member has a plurality of parallel cores, its mechanical reliability is improved, even if the individual cores are thinner than cores used in an insert member comprising only a single core. Plurality of cores provides the advantage that even if one of the cores would be broken or damaged, the strength of the insert member is still maintained at acceptable level due to the other unbroken cores. Insert members, which have a plurality of cores, may be used for example for protection of grinding roll edges.

The cross section of the insert member may be circular, elongated, triangular, quadrangular, parallelogram, polygon or irregular. It is possible to control the flow of the material to be crushed so that the material is more uniformly distributed in the axial direction of the grinding roll. For example, elongated insert members may be placed in angular relationship with the centre line of the grinding roll, so that the insert members guide material which is ground towards the ends of the grinding roll away from the centre part of the grinding roll. It is also possible to improve the crushing results by employing inserts with different cross sectional forms at different locations of the grinding roll.

It is also possible that the body has a shape of a hollow tube, torus or ring. The cores may be arranged in the tube, torus or ring walls, or the core may form a core layer on the inner wall of the body. During the grinding the hollow space inside the insert member is filled with the material which is ground, thus providing autogenous protection.

In one embodiment, the insert member has a plurality of cores, each core having the shape of a sphere.

According to one embodiment of the invention the insert member comprises further a surface layer or coating, which envelopes at least part of the body. The surface layer or coating may be different material than the body or the outer surface of the body may have been treated or processed in a manner that provides it with different characteristics and/or properties than the bulk material of the body. For example, the surface of the body may be carburized. The surface layer or coating may improve the wear resistance of the insert member or it may improve its bonding to the grinding roll. It is also possible that the core comprises a corresponding surface layer or coating, improving the mechanical properties of the core or its bonding to the body. In case a surface layer or coating is arranged on the outer surface of the core before the core is inserted into the body, it will become an intermediate layer between the core and the body.

In one embodiment of the invention it is possible to arrange one or several intermediate layers between the body and the core. The intermediate layer may be material, which is chemically different from materials of both the core and the body. The intermediate layer may also be chemically similar material than the material of the core and/or body, but in that case it differs from them by its physical properties. The intermediate layers may be arranged one at a time on the surface of the core before it is inserted and attached to the body.

The core and the body can be attached to each other with any suitable method which provides for sufficient strength for the attachment. In case both the body and the core are made of composite of metal and ceramic, Cermet, they are typically sintered together. In case the body is made of tool steel and the core is made of composite of metal and ceramic, Cermet, they are attached together by using an adhesive, press fitting, interference fitting or brazing. A suitable adhesive is epoxy based adhesive, preferably two-component epoxy adhesives. In press fitting the core is pressed into a recess in the body, the recess having slightly smaller diameter than the core. The pattern of the insert members along the grinding roll to which they are attached may be varied in order to adapt each grinding roll to different types of wear.

The grinding roll may have a diameter 0.15 m to 5 m, typically 1.0-2.5 m and its length in axial direction may be up to 2.0 m. The grinding roll may be wrought, forged, cast or hot-isostatic pressed steel, and the grinding roll may be expanded by hot forming, e.g., ring rolling. The Vickers hardness of the material of the grinding roll has the same or lower Vickers hardness value than the body. The grinding roll comprises roll ends that extend from the roll edge towards the centre of the grinding roll, and have a length of 10-20% of the total length of the grinding roll. Between these roll ends is located a centre part of the grinding roll, comprising 60-80% of the total length of the grinding roll. Normally the volume flow of the material to be ground is higher in the centre part of the grinding roll than in the roll ends. The circumferential speed of the grinding roll is usually 1 to 2 m/s during the grinding. The grinding roll is used in high pressure grinding unit comprising two counter-rotating rolls which crush the material between them under great hydraulic pressure.

According to one embodiment of the invention the grinding roll is covered by a wear resistant surface layer manufactured by hot isostatic pressing, spray forming, induction hardening, hybrid casting or welding. The surface of the grinding roll may also be surface treated, e.g. by carburized, nitrated or by combinations thereof. By arranging a wear resistant surface layer on the roll surface between the insert members it is possible to reduce the risk of wear underneath an autogenous layer possibly formed during grinding process. The surface layer also protects the roll surface from catastrophic wear in the case of accidental insert member failure and it also protects the surface in case no autogenous layer is formed during grinding. For example, if one or several insert members are damaged and/or broken off during the grinding the wear resistant layer allows more time for the process operator to notice the insert member failure and to react to it, before the surface of the grinding roll is irrevocably damaged. The grinding roll comprises at least one, preferably a plurality of recesses for the insert members comprising a core and a body surrounding the core. The insert member may be attached to the recess of the grinding roll with adhesive bonding, brazing, shrink fitting, welding, press fitting, interference fitting or mechanical joint. An adhesive that may be used for adhesive bonding is epoxy adhesives, especially two-component epoxy adhesives. In many embodiments the adhesive bonding provides a fast, inexpensive and simple way of bonding the insert members to the grinding roll. It also has lower requirements for the clearance of the insert member and recess dimensions. Adhesive bonding may also provide for changing the damaged and/or worn insert members. For example, an adhesive, which is temperature sensitive may used, whereby heating of the roll at the location of the insert member leads to decomposing of the adhesive and makes it possible to remove the insert member from the recess and change it for a new insert member.

The depth of a recess in the grinding roll is typically such that the insert member extends out of the roll surface typically 5-20 mm, more typically 5-15 mm. This makes possible the formation of an autogenous wear protection by crushed material, when the material is capable of being stacked between the insert members. It is also possible that the depth of the recess is such that the end of the insert member is in the same plane with the main roll surface.

It is possible to define an insert member coverage area on the grinding roll. Insert member coverage area denotes here proportion of the additive cross-sectional area of the insert members on a defined surface area of the grinding roll to that defined surface area of the grinding roll, given in %. The insert member coverage area is at least 20%, typically at least 30%, and it does not exceed 100%, and is typically less than 90%. The insert member coverage area may vary on or along the roll surface, and it is typically chosen so that an autogenous layer of the material which is ground is formed between the insert members. The insert member coverage area is may also be chosen so that an even wear of the roll surface is obtained. Typically the the insert member coverage area is higher in the centre part of the grinding roll and lower in the ends of the roll.

According to a second aspect of the invention a cassette for a grinding roll for heavy wear operation is provided, comprising a plurality of insert members according to the features above.

According to a third aspect of the invention a segment for a grinding roll for heavy wear operation is provided, comprising a plurality of insert members or cassettes according the features above.

According to a fourth aspect of the invention a grinding roll for heavy wear operation is provided, comprising a plurality of insert members, cassettes or segments according to the features above.

According to a fifth aspect of the invention a roll machine for comminuting a bed of material is provided, comprising at least one grinding roll according to the features above.

According to a sixth aspect of the invention a method for improving the wear resistance of a high pressure grinding roll is provided.

The invention has mainly been described above with reference to a few embodiments. However, as is readily appreciated by a person skilled in the art, other embodiments than the ones disclosed above are equally possible within the scope of the invention, as defined by the appended claims. Accordingly, the size and shape of the insert member, the body and the core according to the present invention may be varied in a vast number of different embodiments without deviating from the scope of the invention.

The invention claimed is:

1. A grinding roll for heavy wear operation, comprising:

a grinding roll body;

a plurality of segments attached to the grinding roll body, each segment having a support member having an outer surface; and a plurality of elongated insert members extending along a longitudinal axis, the insert members being supported in the support member and extending from the outer surface in a longitudinal direction, each of the insert members including a core of a first material having a first hardness, said core extending in the longitudinal direction of the insert member and including first and second axial ends, and a body of a second material having a second hardness, said body including first and second ends and enclosing said core in a radial direction to protect edges of the core, wherein the first and second axial ends of the core do not extend past the first and second ends of the body in the longitudinal direction, wherein the first hardness is greater than the second hardness.

2. The grinding roll of claim 1, wherein said first material has a first toughness and said second material has a second toughness, and wherein the first toughness is smaller than the second toughness.

3. The grinding roll of claim 1, wherein said first material is selected from a group comprising metallic material, ceramic material or a combination thereof.

4. The grinding roll of claim 1, wherein said second material is selected from a group comprising metallic material, ceramic material or a combination thereof.

5. The grinding roll of claim 1, wherein said first material has a hardness from at least 600 to 1200 HV.

6. The grinding roll of claim 1, wherein said second material has a hardness from 400 to 1200 HV.

7. The grinding roll of claim 1, wherein the cross-section of said insert member is cylindrical.

8. The grinding roll of claim 1, wherein said insert member has the shape of a pin.

9. The grinding roll of claim 1, wherein said core is cylindrical.

10. The grinding roll of claim 1, wherein the geometric center axis of said core is unaligned with the geometric center axis of said insert member.

11. The grinding roll of claim 1, wherein said core extends along the entire length of said insert member in the longitudinal direction.

12. The grinding roll of claim 1, wherein said core extends from the top of said insert member and along a part of the length of said insert member in the longitudinal direction.

13. The grinding roll of claim 1, wherein the outer surface of said insert member is profiled.

* * * * *